US005825380A

United States Patent [19]

Ichizawa et al.

[11] Patent Number: 5,825,380

[45] Date of Patent: Oct. 20, 1998

[54] INK-JET RECORDING HEAD CLEANING METHOD AND CLEANING CARTRIDGE THEREFOR

[75] Inventors: Nobuyuki Ichizawa; Ken Hashimoto, both of Minami-ashigara, Japan

[73] Assignee: Fuji Xerox Co., Ltd., Tokyo, Japan

[21] Appl. No.: 685,720

[22] Filed: Jul. 24, 1996

[30] Foreign Application Priority Data

Jul. 25, 1995 [JP] Japan ..... 7-208551

[51] Int. Cl.[6] ..... B41J 2/165; B41J 2/17

[52] U.S. Cl. ..... 347/28; 347/30; 347/95

[58] Field of Search ..... 347/22, 28, 27, 347/29, 59, 84, 85, 95; 15/320; 134/30

[56] References Cited

U.S. PATENT DOCUMENTS

| | | | |
|---|---|---|---|
| 4,256,610 | 3/1981 | Hwang | 510/170 |
| 5,300,958 | 4/1994 | Burke et al. | 347/28 |
| 5,500,659 | 3/1996 | Curran, Jr. et al. | 347/28 |
| 5,589,861 | 12/1996 | Shibata | 347/22 |

FOREIGN PATENT DOCUMENTS

| | | |
|---|---|---|
| A-58-71170 | 4/1983 | Japan . |
| A-61-56263 | 3/1986 | Japan . |
| A-63-260451 | 10/1988 | Japan . |
| B2-3-48953 | 7/1991 | Japan . |
| A-4-115954 | 4/1992 | Japan . |
| B2-5-21746 | 3/1993 | Japan . |
| A-5-194888 | 8/1993 | Japan . |
| B2-5-55555 | 8/1993 | Japan . |
| A-6-8471 | 1/1994 | Japan . |

*Primary Examiner*—Peter S. Wong
*Assistant Examiner*—Gregory J. Toatley, Jr.
*Attorney, Agent, or Firm*—Oliff & Berridge, PLC.

[57] ABSTRACT

An ink-jet recording head cleaning method and an ink-jet recording head cleaning cartridge for use in the method are disclosed. The cartridge 3 contains a cleaning liquid comprising water and a surfactant, and an ink cartridge is replaceable therewith. In cleaning a heating head 2 of an ink-jet recording apparatus having a removable ink cartridge, the ink cartridge is replaced with the head cleaning cartridge 3 to clean the head with the cleaning liquid contained in the head cleaning cartridge. The cartridge can be packed with a cleaning liquid holder comprising either a porous material or a nonwoven fabric made of chemical fibers. Tho head cleaning method is low-cost, does not impose any limitation on ink design, is free from the problem of printing density change which occurs during long-term use, and has an advantage that ink changes are easy.

21 Claims, 2 Drawing Sheets

INK-JET RECORDING HEAD CLEANING METHOD AND CLEANING CARTRIDGE THEREFOR

FIELD OF THE INVENTION

The present invention relates to an ink-jet recording head cleaning method for cleaning the ink-jet recording head (hereinafter sometimes referred to as a "recording heads" or "ink-jet head") of an ink-jet recording apparatus, and to an ink-jet recording head cleaning cartridge for use therein.

BACKGROUND OF THE INVENTION

Ink-jet recording apparatuses in which an ink which is either liquid or a melt of a solid is ejected from a nozzle, slit, porous film, etc. to conduct recording on paper, cloth, film, or other surfaces, i.e., the so-called ink-jet printers, have various advantages including small size, inexpensiveness, and silence. Various types of such ink-jet printers for monochromic black printing or full-color printing are on the market. Of these, the so-called thermal ink-jet printers, in which ink droplets are formed by the action of heat energy to conduct recordings have many advantages in, for example, that high-speed printing and high resolution are obtained.

On the other hand, the inks for use in ink-jet printers should be regulated in many points. The most required performance among these is excellent stability over a prolonged use period. Especially in the ink-jet printers in which heat energy is used, foreign substances are apt to deposit on the surface of the heating head by the action of heat and this deposit impairs the formation of ink droplets, resulting in a decrease in printing density. Consequently, stability over long-term use is an important subject.

Various proposals have hitherto been made on the above subject. For example, a technique of removing inorganic impurities, i.e., phosphorus, calcium, magnesium, manganese, iron, aluminum, and silicon, from ink dyes for use in thermal ink-jet printers is proposed in JP-B-5-55555 (the term "JP-B" as used therein means an "examined Japanese patent publication") and JP-B-3-48953, and a technique of using dyes of specific molecular structures containing sulfo, carboxy, azo, hydroxyl, and imino groups is proposed in JP-A-61-56263 (the term "JP-A" as used herein means an "unexamined published Japanese patent application"). Further, JP-A-5-194888 proposes a method for enhancing stability over long-term use by adding a bile acid salt as an additive to an ink.

Each of these conventional techniques each has succeeded in providing an improved ink showing smaller fluctuations in concentration and having a longer service life than conventional inks. However, these conventional inks, when used a longer period, undergo a concentration change that cause troubles. In addition, such inks have drawbacks of a decrease in the freedom of ink design, a considerable cost increases and poor ink contact with ink cartridge materials.

In JP-A-63-260451 and JP-A-6-8471 are proposed ink-jet recording apparatuses equipped with a cleaning liquid tank for head cleaning. However, since the proposed apparatuses each has a structure in which switching between an ink and the cleaning liquid is conducted somewhere in the ink channel, they cannot sufficiently cope with ink changes. This is because the ink channel cannot be cleaned.

SUMMARY OF THE INVENTION

The present invention has been achieved in view of the above-described problems of conventional techniques.

An object of the present invention is to provide an ink-jet head cleaning method which is low-cost, does not impose any limitation on ink design, is free from the problem of printing density change which occurs during long-term use, and has an advantage that ink changes are easy.

Another object of the present invention is to provide an ink-jet head cleaning cartridge for use in the above method.

As a result of intensive studies, the present inventors have found that by using a removable head-cleaning cartridge containing a cleaning liquid, the whole ink channel can be cleaned by a simple mechanism at any desired time. It has also been found that use of a removable head-cleaning cartridge containing a cleaning liquid comprising water and a surfactant is effective in eliminating printing density changes resulting from long-term use, at low cost without imposing any limitation on ink design. The present invention has been achieved based on these findings.

The present invention provides an ink-jet head cleaning method for cleaning a recording head of an ink-jet recording apparatus having a removable ink cartridge, which comprises replacing the ink cartridge with a head cleaning cartridge in which a cleaning liquid is held and cleaning the recording head with the cleaning liquid.

Another embodiment of the ink-jet head cleaning method of the present invention for cleaning a recording head of an ink-jet recording apparatus having a removable ink cartridge comprises replacing the ink cartridge with a head cleaning cartridge in which a cleaning liquid is held and cleaning the head with the cleaning liquid by repeatedly conducting both ejection from the recording head (e.g., by the thermal action of the heating head) and either pressurizing or suction.

The ink-jet recording head cleaning cartridge (hereinafter referred to as a "cleaning cartridge" or "ink-jet head cleaning cartridge") of the present invention is characterized in that an ink cartridge is replaceable therewith and that it contains a cleaning liquid comprising water and a surfactant.

BRIEF DESCRIPTION OP THE DRAWINGS

[Description of the Symbols]

Figure 1:
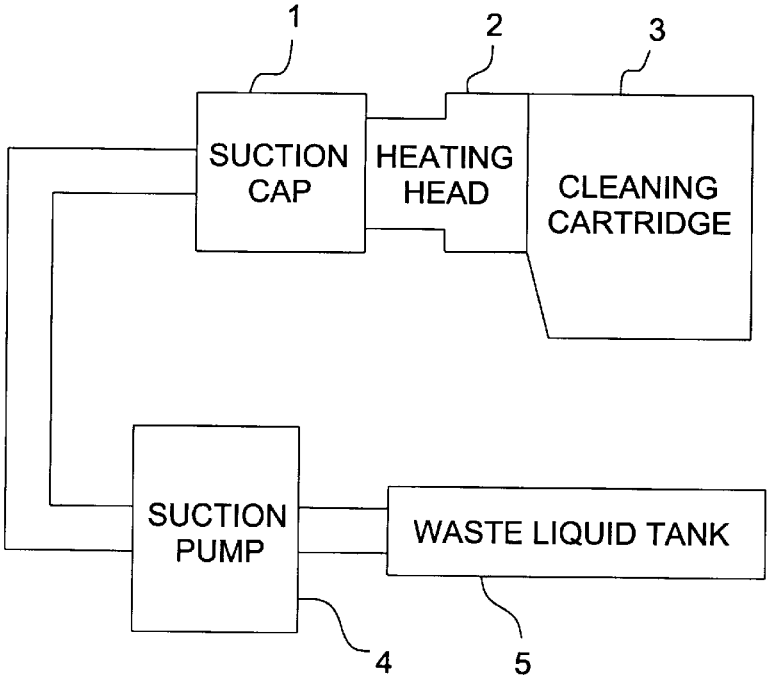
FIG. 1 is a diagrammatic view illustrating the constitution of an example of an ink-jet recording apparatus on which the cleaning cartridge of the present invention has been mounted.

1 . . . suction cap, 2 . . . heating head, 3 . . . cleaning cartridge, 4 . . . suction pump, 5 . . . waste liquid tank, 6 . . . pressure pump, 31 . . . cartridge main body, 32 . . . discharge opening, 33 . . . opening for connection to pressure pump, 34 . . . lid, 35 . . . cleaning liquid absorber.

DETAILED DESCRIPTION OF THE INVENTION

Embodiments of the present invention are described below in detail.

The cleaning cartridge of the present invention is a cartridge for cleaning purposes only, which is for use in an ink-jet recording apparatus in which the tank cartridge part is separable from the head part. The cleaning cartridge contains a cleaning liquid in its tank part and is mounted in a removable manner. Use of this cleaning cartridge for cleaning purposes only eliminates the necessity of providing the apparatus with a cleaning liquid tank inside, and makes it possible to clean the heating head part according to need after replacing an ink cartridge with the cleaning cartridge. Since this cleaning operation is effective-not only in removing foreign substances adherent to the heating head part but in cleaning the whole ink channel, shifting to an ink cartridge of another color is possible after the cleaning. Thus, shifting to an ink of another color is easy.

The cleaning cartridge of the present invention is also effective in cleaning other kinds of recording heads, e.g., piezoelement heads. It is however preferred to apply the cleaning cartridge to heating heads because the cartridge is especially effective in removing scorch deposits (koga), etc.

The cleaning cartridge of the present invention may have the same shape as a removable ink cartridge. In this case, a cartridge filled with a cleaning liquid in place of an ink can be used as it is. A special cartridge designed for cleaning purposes only may be used which has an opening in its back in order to pressurize and send out the cleaning liquid.

The cleaning of a recording head is preferably conducted in such a manner that formation of cleaning liquid droplets by applying heat energy to the cleaning liquid and either pressurizing or suction are performed alternately. The number of these operations is desirably from 1 to 10, but it is preferably from 5 to 10 for heightening the cleaning effect. Although the cleaning operations may be conducted more than ten times, this is not efficient because not only the consumption of the cleaning liquid is increased but also the cleaning affect is not enhanced any more.

The pressurizing pressure and auction pressure are preferably +30,000 to +50,000 Pa and −30,000 to −50,000 Pa from the atmospheric pressure (about 100,000 Pa).

The cleaning cartridge of the present invention may be constituted of a tank alone, or may be packed with a cleaning liquid holder for preventing cleaning liquid leakage. The cleaning liquid holder may be a material known as an ink holder. Examples thereof include foams, liquid-absorber materials, porous materials, and fibrous materials made of chemical or other fibers. These materials may be used alone or in combination.

The cleaning liquid used in the present invention, which is held in the cleaning cartridge, comprises water and a surfactant as essential components. Additives may be added to the cleaning liquid if desired and necessary. Examples of such optional additives include water-soluble organic solvents, pH regulators, hydrotropic agents, chelating agents, clathrate compounds, oxidizing agents, antioxidants, reducing agents, enzymes, bactericides, antifoaming agents, and abrasive materials.

Ion-exchanged water or ultrapure water is preferably used as the water.

The surfactant contained in the cleaning liquid for use in the present invention may be any of nonionic, anionic, cationic, and amphoteric surfactants.

Examples of the nonionic surfactants include polyoxyethylene nonylphenyl ether, polyoxyethylene octylphenyl ether, polyoxyethylene dodecylphenyl ether, polyoxyethylene alkyl ethers, polyoxyethylene/fatty acid esters, sorbitan/fatty acid esters, polyoxyethylene/polyoxypropylene block copolymers, polyoxyethylene-sorbitan/fatty acid esters, fatty acid alkylolamides, and Surfynol (acetylene glycol derivatives).

Examples of the anionic surfactants include alkylbenzenesulfonic acid salts, alkylnaphthalenesulfonic acid salts, alkylnaphthalenesulfonic acid salt/formalin condensates, higher fatty acid salts, higher fatty acid ester/sulfuric ester salts, higher fatty acid ester/sulfonic acid salts, higher alcohol ether/sulfuric ester salts, higher alcohol ether/sulfonic acid salts, higher alkylsulfonamide/alkylcarboxylic acid salts, sulfosuccinic acid salts and ester salts thereof, alkylphosphorous acid salts, alkylphosphoric acid salts, alkylphosphonic acid salts and esters, and higher alcohol/phosphoric acid eater salts.

Examples of the cationic surfactants include primary, secondary, and tertiary amine salts and quaternary ammonium salts. Examples of the amphoteric surfactants include betaines, sulfobetaines, and sulfate betaines. Other usable surfactants include silicone surfactants, fluorochemical surfactants, and natural or biosurfactants such as lecithin, saponin, and cholic acid salts.

These surfactants may be used either alone or as a mixture of two or more thereof. Desirable of those surfactants are anionic surfactants, which are superior in cleaning power. The content of the surfactant is from 0.01 to 50% by weight based on the total amount of the cleaning liquid, preferably from the critical micelle concentration of the surfactant to 30% by weight of the cleaning liquid amount.

A substance generally known as a builder can be added in order to improve the cleaning ability of the surfactant. Examples thereof include sodium carbonate, sodium tripolyphosphate, potassium pyrophosphate, sodium silicate, sodium sulfate, sodium aminosilicate, carboxymethyl cellulose, and methyl cellulose.

Examples of the water-soluble organic solvents usable for preventing the cleaning liquid from drying include polyhydric alcohols and derivatives thereof such as alkyl ethers. Specific examples thereof include glycerol, polyethylene glycol, polypropylene glycol, diethylene glycol, BCBT[2(2-butoxyethoxy)ethanol], diethylene glycol phenyl ether, propylene glycol, propylene glycol monomethyl ether, butylene glycol, triethylene glycol, thiodiglycol, hexylene glycol, ethylene glycol methyl ether, diethylene glycol methyl ether, pentanediol, hexanetriol, and trimethylol propane.

Other usable water-soluble organic solvents include saturated aliphatic alcohols such as methyl alcohol, ethyl alcohol, n-propyl alcohol, isopropyl alcohol, n-butyl alcohol, and hexyl alcohol; amides such as dimethylformamide and dimethylacetaldehyde; ketones such as acetone and diacetone alcohol; keto-alcohols; polysaccharides such as amylose (dextrin), cellulose, gum arabic, and sodium alginate; high-boiling nitrogenous solvents such as triethanolamine, diethanolamine, pyrrolidone, N-methylol-2-pyrrolidone, and 1,3-dimethyl-2-imidazolidinone; and sulfurized solvents such as diethyl sulfoxide and sulfolane. The water-soluble organic solvents usable in the present invention should not be construed as being limited to these examples.

The cleaning liquid for use in the present invention shows improved cleaning ability, when regulated so as to have a heightened pH. However, since too high pH values exceeding 12 tend to cause cleaning troubles such as, e.g., the corrosion, dissolution, or delamination of the head material, the pH of the cleaning liquid is desirably regulated to a value of from 7 to 12, preferably from 7 to 10. For enhancing the cleaning effect, the pH of the cleaning liquid is desirably higher than that of the ink used. Examples of usable pH regulators include sodium hydroxide, potassium hydroxide, lithium hydroxide, sodium sulfate, acetic acid salts, lactic acid salts, benzoic acid salts, triethanolamine, ammonia, ammonium phosphate, sodium phosphate, and lithium phosphate. Further, generally employed buffers and good buffers can be used, The pH regulators usable in the present invention should not be construed as being limited to these examples.

The surface tension of the cleaning liquid for use in the present invention is desirably regulated to 40 mN/m or lower. However, surface tensions lower than 20 mN/m are undesirable in that a cleaning liquid having such a low surface tension leaks out of the head tip part to form a deposit on that part and foul the inside of the apparatus. If the surface tension of the cleaning liquid exceeds 40 mN/m, the wettability of a scorch deposit (kaga) on the head by the cleaning liquid is reduced. Since an ejection cleaning technique is employed in the present invention, the reduced wettability leads to reduced ejection reliability, resulting in reduced cleaning ability. Consequently, the surface tension of the cleaning liquid is desirably regulated to a value of from 20 to 40 mN/m.

The viscosity of the cleaning liquid for use in the present invention is desirably from 1.1 to 7.0 mPa.s, preferably from 1.5 to 4.0 mPa.s. Viscosities thereof lower than 1.1 mPa.s are undesirable in that such a cleaning liquid should have a reduced content of a humectant and this results in a greater tendency for the cleaning liquid to dry. If the viscosity of the cleaning liquid exceeds 7.0 mPa.s, an ejection trouble occurs to make cleaning by ejection impossible.

It should be noted that if an ink is formulated to have a cleaning function so as to eliminate the use of a cleaning liquid for cleaning purposes only, the ink necessarily has a high pH and a low surface tension, so that ink contact, ejection stability, and reliability are impaired. Therefore, a cleaning liquid should be prepared and used separately from an ink.

Examples of the hydrotropic agents include carboxylic acid salts such as sodium butyrate and sodium salicylate, aromatic sulfonic acid salts such as sodium toluenesulfonate, lower alcohols such as ethyl alcohol, urea, and acetamide.

Examples of the chelating agents include ethylenediaminetetraacetic acid (EDTA), iminodiacetic acid (IDA)* ethylenediaminedi(o-hydroxyphenylacetic acid) (EDDHA), nitrilotriacetic acid (NTA), dihydroxyethylglycine (DHEG), trans-1,2-cyclohexanediaminetetraacetic acid (CyDTA), diethylenetriamine-N,N,N',N",N"-pentaacetic acid (DTPA), and glycol etherdiamine-N,N,N',N'-tetraacetic acid (GEDTA). Examples of the clathrate compounds include urea, thiourea, desoxycholic acid, bis(N,N'-tetramethylenebenzidine), cyclophanes, and cyclodextrin. Preferred of these are urea and cyclodextrin.

Besides the additives described above, other additives such as, e.g., oxidizing agents, antioxidants, reducing agents, enzymes, bactericides, antifoaming agents, and abrasive materials may be added if desired and necessary.

The ink to which the cleaning method of the present invention is applied may be any of water-based dye inks, pigment dispersion inks, and inks containing additives. Although the method of the present invention produces an excellent cleaning effect irrespective of the kind of the ink used, it is effective particularly in the cleaning of an ink-jet apparatus in which an ink containing an ingredient having the structure of a carboxylic acid or carboxylic acid salt has been used. The reason for this is as follows. Since highly water-resistant dye inks containing a dye having a carboxy group, pigment dispersants having a carboxy group, and water-soluble polymeric additives having carboxy groups have lower solubility in water than the ink dyes, dispersants, and additives which each has a sulfo group, they form on a heater a scorch deposit (koga) which does not redissolve in the water contained in such inks. This deposit can be effectively removed by using the above-described cleaning liquid in the cleaning method of the present invention.

The cleaning method of the present invention, in which the cleaning liquid described above is used, is more effective when applied to long-life apparatuses of $1\times10^8$ pulses or more. Further, ejection apparatuses having a drop amount of 35 pl or smaller suffer a larger change in drop amount because scorching (kogation) is apt-to occur on the recording head (e.g., heating head) due to the small drop amount. The cleaning liquid and cleaning method of the present invention are hence especially effective in such apparatuses.

A deposit accumulated on a heating head during long-term use of the head due to the dye or due to impurities which came into the dye or solvent can be effectively removed by replacing the ink cartridge with the cleaning cartridge of the present invention and cleaning the ink channel with the cleaning liquid. Thus, the apparatus can recover from a printing density decrease caused by droplet formation failures attributable to such a deposit. Due to the use of the independent cleaning cartridge, which is mounted in a removable manner, cleaning can be conducted at any desired time by a simple mechanism. Furthermore, since the whole ink channel can be cleaned, shifting to a cartridge of an ink of another color is easy.

In the present invention, an ink cartridge may be used as it is as the cleaning cartridge.

The cleaning method of the present invention has an exceedingly high cleaning ability because the adhesion strength of a deposit of foreign substances formed on the recording head (e.g., heating head) surface is reduced by ejecting a cleaning liquid and the deposit is peeled off the recording head by suction or pressurizing.

When a cleaning liquid having a pH of from 7 to 12 is used in the cleaning method of the present invention, a high cleaning ability can be maintained without exerting an adverse influence on the head material during cleaning.

Therefore, the cleaning method of the present invention, in which the cleaning cartridge of the present invention is used, can eliminate the necessity of intricate design, e.g., dye structure regulation, and of further purification of commercial dyes or pigments. Thus, the problem of cost increase can be eliminated.

The cleaning method of the present invention is effective in the cleaning of not only ink-jet recording apparatuses employing a water-based dye ink, but also ink-jet recording apparatuses employing a pigmented ink, an oil-soluble-dye ink, or a suspension, emulsion, or another dispersion system containing a resin, a wax, an oil, etc.

The present invention will be explained below in more detail by reference to the following Examples, but the invention should not be construed as being limited thereto.

EXAMPLE 1

FIG. 1 is a diagrammatic view illustrating the constitution of an ink-jet recording apparatus on which a cleaning cartridge of the present invention has been mounted. In this apparatus, the removable cleaning cartridge 3 of the present invention has been connected to a heating head 2. The head tip part has been connected to a suction cap 1 for ink auction, and the cap 1 has been connected to a waste liquid tank 5 via a suction pump 4.

The cleaning cartridge contains a cleaning liquid having the following composition.

| | |
|---|---|
| Ion-exchanged water | 80 pts.wt. |
| Sodium dodecylbenzenesulfonate | 0.2 pts.wt. |
| Diethylene glycol | 20 pts.wt. |
| 5% Aqueous lithium hydroxide solution | for pH adjustment to 11.0 |

When it has become necessary to clean the heating head, the ink cartridge is demounted from the ink-jet recording apparatus, and the cleaning cartridge 3 is connected to the heating head 2. The heating head 2 is moved to a nonprint part where the suction pump 4 is present. Subsequently, the tip part of the heating head 2 is connected to the suction cap 1 to enable the cleaning liquid to be fed to the heating head 2 by means of the suction pump 4. The cleaning liquid is ejected at a driving frequency of 5.0 Hz by the action of the heat energy of the heating head For example, $1\times10^4$ pulse ejection is conducted, followed by 1-second suction. This cleaning operation is conducted 6 times to remove the deposit of foreign substances adherent to the heating head. The waste liquid resulting from the cleaning is sent via the suction pump 4 to the waste liquid tank 5 and stored therein.

EXAMPLE 2

Figure 2:
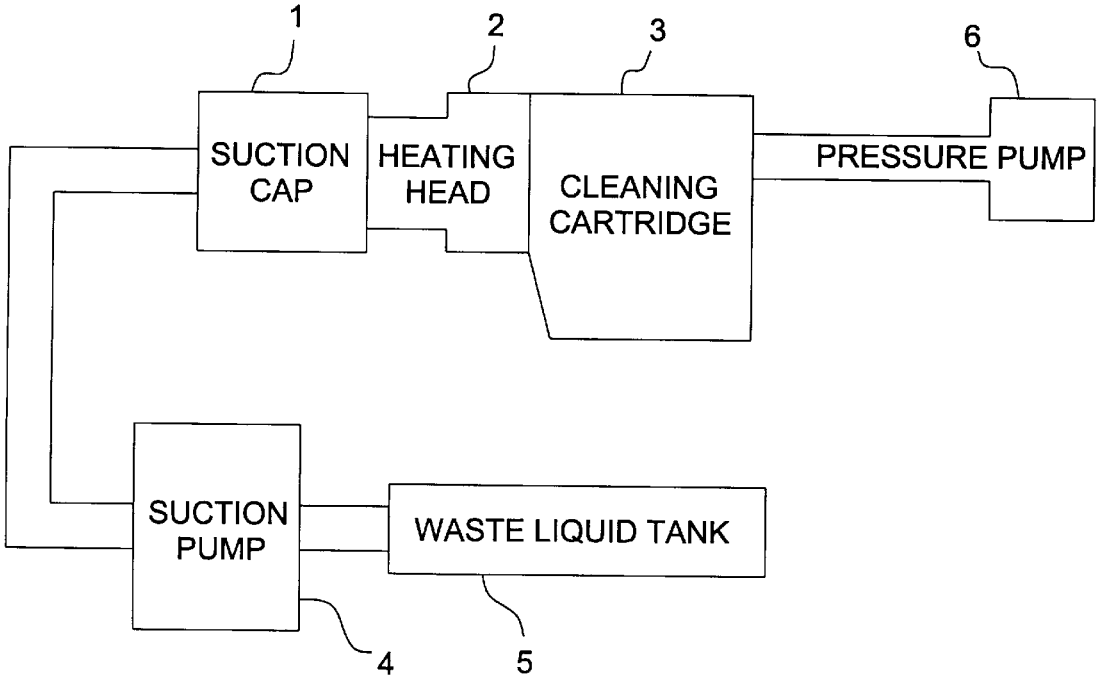
FIG. 2 is a diagrammatic view illustrating the constitution of another example of an ink-jet recording apparatus on which the cleaning cartridge of the present invention has been mounted.

FIG. 2 is a diagrammatic view illustrating the constitution of another ink-jet recording apparatus on which a cleaning cartridge of the present invention has been mounted. In this case, a pressure pump 6 is used. As in the apparatus described above, the removable cleaning cartridge 3 has been connected to a heating head 2 of the ink-jet recording apparatus. The cleaning cartridge 3 has been connected to the pressure pump 6 for cleaning purposes only so as to feed a cleaning liquid. The tip part of the heating head has been connected to a suction cap 1 for ink suction, and the cap 1 has been connected to a waste liquid tank 5 via a suction pump 4. The cleaning cartridge 3 has an opening only for connection to the pressure pump 6.

Figure 3:
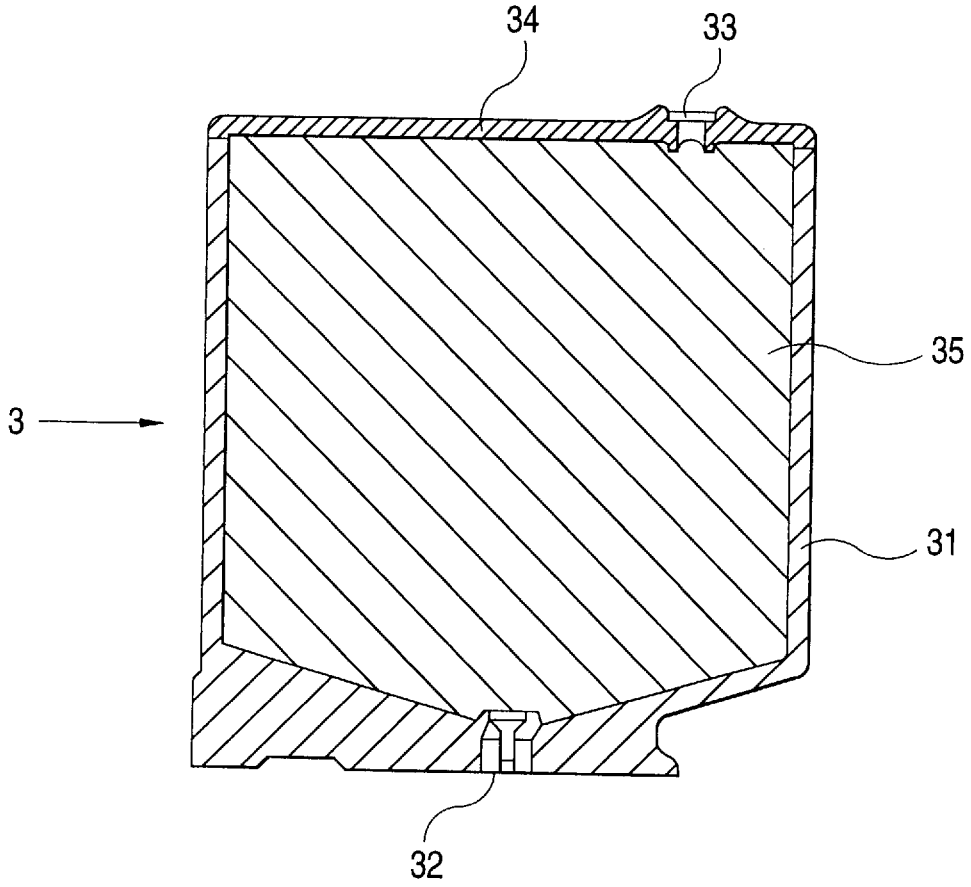
FIG. 3 is a sectional view of one embodiment of the cleaning cartridge of the present invention.

FIG. 3 is a sectional view of one embodiment of the cleaning cartridge of the invention shown in FIG. 2. The cartridge 3 comprises a cartridge main body 31 having a discharge opening 32 on one side and a lid 34 having an opening 33 for connection to the pressure pump. The cartridge 3 is packed with a cleaning liquid absorber 35, in which the same cleaning liquid as in Example 1 is held.

When it has become necessary to clean the heating head, the ink cartridge is demounted from the ink-jet recording apparatus, and the cleaning cartridge 3 is connected to the heating head 2. The heating head 2 is moved to a nonprint part where the suction pump 4 and the pressure pump 6 are present. Subsequently, the pressure pump 6 is connected to the cleaning cartridge 3, and the tip part of the heating head 2 is connected to the suction cap 1. The cleaning liquid is fed by means of the pressure pump 6 or the suction pump 4. The cleaning liquid is ejected at a driving frequency of 5.0 Hz by the action of the heat energy of the heating head. For example, $1\times10^4$ pulse ejection is conducted, and the cleaning liquid is then ejected for 1 second by pressurizing with the pressure pump 4. This cleaning operation is conducted 8 times to remove the deposit of foreign substances adherent to the heating head. The waste liquid resulting from the cleaning is sent via the suction pump 4 to the waste liquid tank 5 and stored therein.

In the cleaning method shown in Example 2, the ejection by heat energy and the pressurizing may be conducted alternately with suction.

The cleaning effects of cleaning liquids are then demonstrated below.

For the evaluation of cleaning effect, the following three standard black inks and one standard color ink were prepared.

| Standard Ink (Black) (1) | |
|---|---|
| Ion-exchanged water | 80 pts.wt. |
| C.I. Direct Black 195 | 4 pts.wt. |
| Glycerol | 10 pts.wt. |
| Diethylene glycol | 5 pts.wt. |
| BES/LiOH | for pH adjustment to 7.0 |

BES : (N,N-Bis(2-hydroxyethyl)-2-aminoethanesulfonic acid ($C_6H_{15}NO_5S$).

This ink had a viscosity of 2.0 mPa.s and a surface tension of 58 mN/m.

| Standard Ink (Black) (2) | |
|---|---|
| Ion-exchanged water | 80 pts.wt. |
| C.I. Direct Black 168 | 3 pts.wt. |
| Nonionic surfactant (Nissan Nonion E230 (trade name), manufactured by Nippon Oil & Fats Co., Ltd., Japan) | 0.1 pt.wt. |
| Diethylene glycol | 15 pts.wt. |
| Ethyl alcohol | 3 pts.wt. |

This ink had a pH of 8.6, a viscosity of 2.3 mPa.s, and a surface tension of 40 mN/m.

| Standard Ink (Black) (3) | |
|---|---|
| Ion-exchanged water | 80 pts.wt. |
| C.I. Direct Black 168 | 3 pts.wt. |
| Nonionic surfactant (Nissan Nonion E230 (trade name), manufactured by Nippon Oil & Fats Co., Ltd.) | 0.1 pt.wt. |
| Diethylene glycol | 10 pts.wt. |
| Thiodiglycol | 5 pts.wt. |
| Isopropyl alcohol | 3 pts.wt. |
| BES/LiOH | for pH adjustment to 7.0 |

This ink had a viscosity of 2.3 mPa.s and a surface tension of 40 mN/m.

| Standard Ink (Color) (4) | |
|---|---|
| Ion-exchanged water | 80 pts.wt. |
| C.I. Direct Yellow 86 | 2 pts.wt. |
| Diethylene glycol | 15 pts.wt. |
| BES/NaOH | for pH adjustment to 7.0 |

EXAMPLE 3

A $1\times10^7$ pulse ejection test was performed using standard ink (2). The ink cartridge was then replaced with a cartridge containing the same cleaning liquid as in Example 1 to conduct cleaning. Thereafter, a cartridge containing standard ink (color) (4) was mounted to conduct printing. As a result, satisfactory yellow prints free from color mixing were obtained.

COMPARATIVE EXAMPLE 1

A $1\times10^7$ pulse ejection test using standard ink (2) was performed in the same manner as in Example 3. Thereafter, a cartridge containing standard ink (color) (4) was mounted without cleaning, and printing was then conducted. As a result, the print obtained immediately after initiation of ejection had suffered considerable yellow/black color mixing. Even when ejection was continued thereafter, the color mixing caused by the residual black-ink lasted for a long time.

EXAMPLE 4

Using standard ink (2), $1\times10^7$ pulse and $1\times10^8$ pulse ejection tests were performed. Thereafter, cleaning was conducted using a cleaning liquid having the following composition to evaluate its cleaning effect. The results obtained are shown in Table 1.

| | |
|---|---|
| Ion-exchanged water | 80 pts.wt. |
| Sodium dodecylbenzenesulfonate | 0.2 pts.wt. |
| Diethylene glycol | 20 pts.wt. |

The above ingredients were sufficiently mixed, and the pH of the resulting solution was adjusted to 11.0 with 5% aqueous lithium hydroxide solution. This cleaning liquid had a viscosity of 2.2 mPa.s and a surface tension of 38 mN/m.

EXAMPLE 5

Using standard ink (2), $1\times10^7$ pulse and $1\times10^8$ pulse ejection tests were performed. Thereafter, cleaning was conducted using a cleaning liquid having the same composition as in Example 4 without adjusting the pH of the cleaning liquid. This cleaning liquid had a pH of 7.5, a viscosity of 2.2 mPa.s, and a surface tension of 38 mN/m. Thus, the cleaning effect of the cleaning liquid was evaluated. The results obtained are shown in Table 1.

EXAMPLE 6

Using standard ink (3), $1\times10^7$ pulse and $1\times10^8$ pulse ejection tests were performed. Thereafter, cleaning was conducted using a cleaning liquid having the following composition to evaluate its cleaning effect. The results obtained are shown in Table 1.

| | |
|---|---|
| Ion-exchanged water | 80 pts.wt. |
| Sodium laurate | 2 pts.wt. |
| Glycerol | 30 pts.wt. |
| Carboxymethyl cellulose | 0.1 pt.wt. |

The above Ingredients were sufficiently mixed, and the pH of the resulting solution was adjusted to 8.0 with 10% aqueous ammonium phosphate solution and 5% aqueous citric acid solution. This cleaning liquid had a viscosity of 3.8 mPa.s and a surface tension of 37 mN/m.

EXAMPLE 7

Using standard ink (2), $1\times10^7$ pulse and $1\times10^8$ pulse ejection teats were performed. Thereafter, cleaning was conducted using a cleaning liquid having the same composition as in Example 6 to evaluate its cleaning effect. The results obtained are shown in Table 1.

EXAMPLE 8

Using standard ink (1), $1\times10^7$ pulse and $1\times10^8$ pulse ejection tests were performed. Thereafter, cleaning was conducted using a cleaning liquid having the following composition to evaluate its cleaning effect. The results obtained are shown in Table 1.

| | |
|---|---|
| Ion-exchanged water | 80 pts.wt. |
| Nonionic surfactant (Nissan Nonion P223 (trade name), manufactured by Nippon Oil & Fats Co., Ltd.) | 0.2 pts.wt. |
| Diethylene glycol | 15 pts.wt. |
| Sodium carbonate | 0.3 pts.wt. |
| Urea | 2 pts.wt. |
| Ethyl alcohol | 2 pts.wt. |

The above ingredients were sufficiently mixed, and the pH of the resulting solution was adjusted to 8.0 with 5% aqueous triethanolamine solution.

This cleaning liquid had a viscosity of 2.1 mPa.s and a surface tension of 38 mN/m.

EXAMPLE 9

Using standard ink (1), $1\times10^7$ pulse and $1\times10^8$ pulse ejection tests were performed. Thereafter, cleaning was conducted using a cleaning liquid having the following composition to evaluate its cleaning effect. The results obtained are shown in Table 1.

| | |
|---|---|
| Ion-exchanged water | 80 pts.wt. |
| Glycerol | 15 pts.wt. |

The above Ingredients were sufficiently mixed to prepare the cleaning liquid. This cleaning liquid had a pH of 7.1, a viscosity of 2.1 mPa.s, and a surface tension of 60 mN/m.

EXAMPLE 10

Using standard ink (2), $1\times10^7$ pulse and $1\times10^8$ pulse ejection tests were performed. Thereafter, cleaning was conducted using a cleaning liquid having the following composition to evaluate its cleaning effect. The results obtained are shown in Table 1.

| | |
|---|---|
| Ion-exchanged water | 80 pts.wt. |
| Sodium laurate | 0.01 pt.wt. |
| Glycerol | 15 pts.wt. |

The above ingredients were sufficiently mixed, and the pH of the resulting solution was adjusted to 7.5 with 10% aqueous sodium carbonate solution. This cleaning liquid had a viscosity of 2.0 mPa.s and a surface tension of 46 mN/m.

EXAMPLE 11

Using standard ink (2), $1\times10^7$ pulse and $1\times10^8$ pulse ejection tests were performed. Thereafter, cleaning was conducted using a cleaning liquid having the following composition to evaluate its cleaning effect. The results obtained are shown in Table 1.

| | |
|---|---|
| Ion-exchanged water | 80 pts.wt. |
| Diethylene glycol | 15 pts.wt. |

The above ingredients were sufficiently mixed, and the pH of the resulting solution was adjusted to 10.0 with 10% aqueous sodium hydroxide solution. This cleaning liquid had a viscosity of 2.0 mPa.s and a surface tension of 60 mN/m.

EXAMPLE 12

Using standard ink (3), $1\times10^7$ pulse and $1\times10^8$ pulse ejection tests were performed. Thereafter, cleaning was

[co]nducted using a cleaning liquid having the following composition to evaluate its cleaning effect. The results obtained are shown in Table 1.

| | |
|---|---|
| Ion-exchanged water | 80 pts.wt. |
| Nonionic surfactant (Surfynol 465, manufactured by Nissin Chemical Industry Co., Ltd., Japan) | 1 pt.wt. |
| Thiodiglycol | 20 pts.wt. |
| Urea | 2 pts.wt. |
| Ethyl alcohol | 2 pts.wt. |

The above ingredients were sufficiently mixed, and the pH of the resulting solution was adjusted to 5.0 with 5% aqueous sulfuric acid solution. This cleaning liquid had a viscosity of 1.7 mPa.s and a surface tension of 33 mN/m.

For evaluating the cleaning liquids, a thermal ink-jet printer employing a thermal ink-jet head of the type shown in JP-A-1-148560 was fabricated and used to examine ejection amount. Continuous ejection tests were performed over $1\times10^7$ and $1\times10^8$ pulses.

| | |
|---|---|
| Initial ejection amount | 102 pl |
| Ejection amount after $1 \times 10^7$ pulse test | 91 pl |
| Election amount after $1 \times 10^8$ pulse test | 79 pl |

The decreases in ejection amount were 11 pl and 23 pl, respectively.

Each cleaning liquid was evaluated based on the following formulae.

After $1\times10^7$ pulse test:

(102 pl (initial ejection amount)−X (ejection amount after cleaning))/11 pl (decrease)×100

After $1\times10^8$ pulse test:

(102 pl (initial ejection amount)−X (ejection amount after cleaning))/23 pl (decrease)×100

○○: ejection amount change was below 5%.

○: ejection amount change was 5 to 10%, excluding 10%.

Δ: ejection amount change was 10 to 30%, excluding 30%.

x: ejection amount change was 30% or higher.

EXAMPLE 13

Examples using a cleaning cartridge packed with a cleaning liquid holder are then described.

Since a removable cleaning cartridge is used in the present invention, there is a possibility that the cleaning liquid might leak from the junction between the cleaning liquid tank and the heating head. It is therefore desirable to pack the cleaning cartridge with a cleaning liquid holder.

Specifically, a polyurethane sponge was used as a holder in cleaning with suction. As a result, the holder showed excellent cleaning liquid-holding ability and gave satisfactory results. Further, a fibrous material showed excellent cleaning liquid-releasing properties as well as excellent cleaning liquid-holding ability, so that the cleaning liquid was fed efficiently and more satisfactory results were obtained.

On the other hand, in cleaning with pressurizing, a cleaning liquid could be satisfactorily fed when a polyurethane sponge having uniformity in void size was used, because pressure was applied from an upper part of the cartridge. Further, a cleaning cartridge designed to prevent cleaning liquid leakage not with a cleaning liquid holder but with only a valve mechanism disposed in the tank was used, and was found to be effective in satisfactorily feeding the cleaning liquid.

The cleaning liquid holders shown above were given as mere examples, and known ink holders may be used as the cleaning liquid holder in this invention.

The cleaning of & heating head with the cleaning cartridge of the present invention can be conducted at any time when ejection from the heating head has become unstable, because the removable ink cartridge is replaced with the cleaning cartridge before cleaning. Consequently, according to the cleaning method of the present invention, an ink-jet recording apparatus can recover its ejection stability without fail, whereby the whole system including the heating head and the ink can have improved reliability. Furthermore, the cleaning method has an advantage that since the whole ink channel can be cleaned, shifting to an ink of another color is easy.

TABLE 1

| | Evaluation Results | | Cleaning Liquid | | | Ink | | |
|---|---|---|---|---|---|---|---|---|
| | $1 \times 10^7$ | $1 \times 10^8$ | pH | Viscosity | Surface tension | pH | Viscosity | Surface tension |
| Example 4 | oo | oo | 11.0 | 2.2 | 38 | 8.6 | 2.3 | 40 |
| Example 5 | oo | o | 7.5 | 1.8 | 37 | 8.6 | 2.3 | 40 |
| Example 6 | oo | oo | 8.0 | 3.8 | 37 | 7.0 | 2.3 | 40 |
| Example 7 | oo | o | 8.0 | 3.8 | 37 | 8.6 | 2.3 | 40 |
| Example 8 | oo | oo | 8.0 | 2.1 | 38 | 7.0 | 2.0 | 58 |
| Example 9 | oo | o | 7.1 | 2.1 | 60 | 7.0 | 2.0 | 58 |
| Example 10 | oo | Δ | 7.5 | 2.0 | 46 | 8.6 | 2.3 | 40 |
| Example 11 | oo | o | 10.0 | 2.0 | 60 | 8.6 | 2.3 | 40 |
| Example 12 | o | Δ | 5.0 | 1.7 | 33 | 7.0 | 2.3 | 40 |

While the invention has been described in detail and with reference to specific embodiments thereof, it will be apparent to one skilled in the art that various changes and modifications can be made therein without departing from the spirit and scope thereof.

What is claimed is:

1. An ink-jet recording head cleaning method for cleaning an ink-jet recording head of an ink-jet recording apparatus, the ink-jet recording apparatus having an ink cartridge removably mounted on the ink-jet recording head, the method comprising:

replacing the ink cartridge with a head cleaning cartridge in which a cleaning liquid is held, the head cleaning cartridge thus being mounted on the ink-jet recording head; and cleaning the ink-jet recording head with the cleaning liquid.

2. The ink-jet recording head cleaning method as claimed in claim 1, wherein the ink-jet recording head has a heating element.

3. The ink-jet recording head cleaning method as claimed in claim 1, wherein the cleaning liquid comprises water and a surfactant.

4. The ink-jet recording head cleaning method as claimed in claim 3, wherein the cleaning liquid has a pH of from 10 to 13.

5. The ink-jet recording head cleaning method as claimed in claim 4, wherein the cleaning liquid has a surface tension of 40 mN/m or lower and a viscosity of from 1.1 to 7.0 mPa.s.

6. The ink-jet recording head cleaning method as claimed in claim 5, wherein the cleaning liquid has a lower surface tension and a higher pH than ink contained in the ink cartridge.

7. The ink-jet recording head cleaning method as claimed in claim 1, wherein the ink-jet recording head is cleaned with the cleaning liquid by conducting ejection of the cleaning liquid from the ink-jet recording head using at least one of pressurizing and suction.

8. The ink-jet recording head cleaning method as claimed in claim 7, wherein the ejection from the ink-jet recording head is achieved through alternating application of pressure and suction.

9. The ink-jet recording head cleaning method as claimed in claim 7, wherein the ejection from the ink-jet recording head and at least one of pressurizing and suction is conducted 1 to 10 times.

10. The ink-jet recording head cleaning method as claimed in claim 7, wherein the ink-jet recording head has a heating element.

11. The ink-jet recording head cleaning method as claimed in claim 7, wherein the cleaning liquid comprises water and a surfactant.

12. The ink-jet recording head cleaning method as claimed in claim 11, wherein the cleaning liquid has a pH of from 10 to 13.

13. The ink-jet recording head cleaning method an claimed in claim 12, wherein the cleaning liquid has a surface tension of 40 mN/m or lower and a viscosity of from 1.1 to 7.0 mPa.s.

14. The ink-jet recording head cleaning method as claimed in claim 13, wherein the cleaning liquid has a lower surface tension and a higher pH than ink contained in the ink cartridge.

15. An ink-jet recording head cleaning cartridge which contains a cleaning liquid comprising water and a surfactant, wherein the ink-jet recording head cleaning cartridge is sized and configured to replace an ink cartridge and mate with and clean an ink-jet recording head.

16. The ink-jet recording head cleaning cartridge as claimed in claim 15, further comprising a cleaning liquid holder within said head cleaning cartridge.

17. The ink-jet head cleaning cartridge as claimed in claim 16, wherein the cleaning liquid holder comprises one of a porous material and a nonwoven fabric made of chemical fibers.

18. An ink-jet recording head cleaning method for cleaning an ink-jet recording head of an ink-jet recording apparatus, the ink-jet recording apparatus having an ink cartridge removably mounted on the ink-jet recording head, the method comprising:

a) removing the ink cartridge from the ink-jet recording head;

b) placing a head cleaning cartridge containing cleaning fluid in the ink-jet recording apparatus on the ink-jet recording head;

c) connecting the ink-jet recording head to a suction cap of the recording apparatus;

d) applying at least one of suction and pressure to the head cleaning cartridge to feed the cleaning fluid from the head cleaning cartridge to the recording head;

e) ejecting cleaning liquid from the recording head into the suction cap; and f) applying suction to the suction cap to send ejected cleaning fluid to a waste liquid tank.

19. The method of claim 18, wherein steps c) and d) send the cleaning fluid through an entire ink channel of the recording head.

20. The method of claim 18, wherein the recording head is a heating head and the step of ejecting cleaning fluid is performed by heat energy of the heating head.

21. An ink-jet recording apparatus capable of ink-jet recording head cleaning, comprising:

an ink-jet recording head;

an ink cartridge removably mounted on the ink-jet recording head;

a head cleaning cartridge removably mountable on the ink-jet recording head in place of the ink cartridge, the head cleaning cartridge having cleaning fluid therein;

one of a source of suction and a source of pressure operably connected to the head cleaning cartridge for feeding the cleaning fluid from the head cleaning cartridge to the ink-jet recording head;

a suction cap removably connected to the ink-jet recording head for sucking the cleaning fluid from the ink-jet recording head; and a waste liquid tank fluidly connected to the suction cap for receiving the cleaning fluid sucked by the suction cap.

* * * * *